US005915595A

United States Patent [19]

Dow et al.

[11] Patent Number: 5,915,595

[45] Date of Patent: Jun. 29, 1999

[54] AEROSOL DISPENSING CONTAINER AND METHOD FOR ASSEMBLING SAME

[75] Inventors: Walter O. Dow, West Chicago; Emil P. Obradovich, Naperville, both of Ill.

[73] Assignee: U.S. Can Company, Oak Brook, Ill.

[21] Appl. No.: 08/701,091

[22] Filed: Aug. 21, 1996

[51] Int. Cl.[6] ..... B65D 83/14

[52] U.S. Cl. ..... 222/95; 222/105; 222/386.5; 222/464.2

[58] Field of Search ..... 222/386.5, 387, 222/389, 464.2, 464.1, 95, 105

[56] References Cited

U.S. PATENT DOCUMENTS

| | | | |
|---|---|---|---|
| 3,429,026 | 2/1969 | Chamberlin | 29/421 |
| 3,433,391 | 3/1969 | Krizka et al. | 222/95 |
| 3,438,818 | 4/1969 | Rowe | 136/170 |
| 3,467,283 | 9/1969 | Kinnavy | 222/95 |
| 3,482,738 | 12/1969 | Bartels . | |
| 3,486,661 | 12/1969 | Friedrich et al. | 222/464.2 X |
| 3,549,050 | 12/1970 | Bruce | 222/464.2 X |
| 3,549,058 | 12/1970 | Boik | 222/386.5 |
| 3,838,977 | 10/1974 | Warren | 23/288 F |
| 3,989,165 | 11/1976 | Shaw et al. | 222/23 |
| 4,032,064 | 6/1977 | Giggard | 229/55 |
| 4,117,951 | 10/1978 | Winckler | 220/461 |
| 4,148,416 | 4/1979 | Gunn-Smith | 222/94 |
| 4,159,789 | 7/1979 | Stoody | 222/148 |
| 4,174,811 | 11/1979 | Binder et al. | 239/308 |
| 4,185,758 | 1/1980 | Giggard | 222/386.5 |
| 4,187,959 | 2/1980 | Pelton | 222/94 |
| 4,189,069 | 2/1980 | Stoody | 222/83.5 |
| 4,198,365 | 4/1980 | Pelton | 264/249 |
| 4,202,470 | 5/1980 | Fujii | 222/130 |
| 4,211,344 | 7/1980 | Stoody | 222/131 |
| 4,238,264 | 12/1980 | Pelton | 156/212 |
| 4,254,894 | 3/1981 | Fetters | 222/1 |
| 4,265,373 | 5/1981 | Stoody | 222/94 |
| 4,293,353 | 10/1981 | Pelton et al. | 156/69 |
| 4,308,973 | 1/1982 | Irland | 220/454 |
| 4,328,843 | 5/1982 | Fujii | 141/1 |
| 4,346,743 | 8/1982 | Miller | 141/3 |
| 4,350,272 | 9/1982 | Petterson | 222/386.5 |
| 4,360,131 | 11/1982 | Reyner | 222/386.5 |
| 4,376,500 | 3/1983 | Banks et al. | 222/386.5 |
| 4,383,399 | 5/1983 | Stoody | 53/470 |
| 4,470,520 | 9/1984 | Sullivan | 222/94 |
| 4,478,044 | 10/1984 | Magid | 60/721 |
| 4,491,250 | 1/1985 | Liebermann | 222/386.5 |
| 4,513,884 | 4/1985 | Magid | 222/94 |
| 4,646,946 | 3/1987 | Reyner | 222/386.5 |
| 4,679,706 | 7/1987 | Magid et al. | 222/130 |
| 4,801,046 | 1/1989 | Miczka | 222/95 |
| 4,867,344 | 9/1989 | Bitterly | 222/94 |
| 4,875,508 | 10/1989 | Burke, II et al. | 141/2 |
| 4,896,794 | 1/1990 | Banks et al. | 221/1 |
| 4,909,420 | 3/1990 | Reyner | 222/386.5 |
| 4,949,871 | 8/1990 | Flanner | 222/95 |
| 4,951,847 | 8/1990 | Hardt et al. | 222/386.5 |
| 4,955,512 | 9/1990 | Sharples | 222/386.5 |

(List continued on next page.)

FOREIGN PATENT DOCUMENTS

| | | |
|---|---|---|
| 1937769 | 7/1970 | Germany . |
| 1134993 | 11/1968 | United Kingdom . |

*Primary Examiner*—Kevin P. Shaver
*Attorney, Agent, or Firm*—Leydig, Voit & Mayer, Ltd.

[57] ABSTRACT

An aerosol dispensing container is provided having a container body attached to top and bottom closures wherein the top closure has a curl defining a valve opening. Disposed in the container opening is a generally cylindrical product bag having a neck portion projecting through the valve opening and forming a flange defining a bag opening, the flange being heat formed to conform to the surface configuration of the Curl after a top portion has been cut off. A valve cup is disposed in the bag opening and has a body wall for engaging the bag opening and forming an air tight seal at an interface between the wall and the bag flange. The valve cup also has a dispensing means product dispenser including a stem for receiving product from the bottom of the bag. and at least one slot disposed in proximity to the body wall for receiving product from the top of the bag. A method for assembling the container is also provided.

4 Claims, 6 Drawing Sheets

U.S. PATENT DOCUMENTS

| | | | |
|---|---|---|---|
| 4,969,577 | 11/1990 | Werding | 222/94 |
| 4,978,033 | 12/1990 | Chou | 222/94 |
| 4,988,018 | 1/1991 | Loychuk | 222/183 |
| 5,007,556 | 4/1991 | Lover | 222/286.5 |
| 5,022,564 | 6/1991 | Reyner | 222/386.5 |
| 5,031,384 | 7/1991 | Rebeyrolle et al. | 53/452 |
| 5,032,619 | 7/1991 | Frutin et al. | 521/55 |
| 5,035,351 | 7/1991 | Moran | 222/394 |
| 5,040,704 | 8/1991 | Moran | 222/394 |
| 5,044,524 | 9/1991 | Pistek | 222/212 |
| 5,069,363 | 12/1991 | Daimler | 222/95 |
| 5,115,944 | 5/1992 | Nikolich | 222/94 |
| 5,123,560 | 6/1992 | Arzani et al. | 222/95 |
| 5,123,571 | 6/1992 | Rebevrolle et al. | 222/105 |
| 5,135,137 | 8/1992 | Rudick | 222/1 |
| 5,137,179 | 8/1992 | Stoffel | 222/95 |
| 5,137,186 | 8/1992 | Moran | 222/394 |
| 5,167,347 | 12/1992 | Wiegner et al. | 222/94 |
| 5,179,982 | 1/1993 | Breube et al. | 141/20 |
| 5,190,184 | 3/1993 | Lechner | 220/581 |
| 5,217,139 | 6/1993 | Miczka et al. | 220/404 |
| 5,248,063 | 9/1993 | Abbott | 222/95 |
| 5,263,519 | 11/1993 | Reyner | 141/20 |
| 5,265,765 | 11/1993 | Maier | 222/105 |
| 5,277,336 | 1/1994 | Youel | 222/105 |
| 5,409,142 | 4/1995 | Wenmaekers et al. | 222/95 |
| 5,497,911 | 3/1996 | Ellion et al. | 222/95 |
| 5,522,526 | 6/1996 | DeLaforcade et al. | 222/1 |
| 5,730,328 | 3/1998 | Maeder et al. | 222/464.2 X |

AEROSOL DISPENSING CONTAINER AND METHOD FOR ASSEMBLING SAME

FIELD OF THE INVENTION

The present invention relates to a dispensing container and, more particularly, to an aerosol dispensing container containing a product chamber formed by a collapsible bag and a propellant chamber formed between the bag and the interior of the container,.

BACKGROUND OF THE INVENTION

One type of aerosol dispensing container has a collapsible bag or pouch-like structure disposed within the container. The interior of the bag defines a product chamber for holding a product to be dispensed. A propellant chamber for holding a pressurized propellant is formed between the interior of the container and the exterior of the bag. The bag has an opening for communicating with the exterior of the container and a dispensing means, typically a valve, for sealing the product chamber and for selectively dispensing the product. The propellant exerts a compressive force on the bag, collapsing the bag and forcing the product to be dispensed from the container as the valve is actuated. Thus, the product is not contaminated by the propellant and the propellant is not vented to the atmosphere.

One type of dispensing container that will be referred to as "insertion container" requires an assembly method which will be referred to as the "insertion method." The insertion method requires assembly of a cylindrical side body, top and bottom closures and a special type of plastic bag which is adapted to be inserted into a valve opening, typically about one inch in diameter, in the top closure. Since the "insertable" bag must be able to fit through the relatively small valve opening, it must be specially constructed to permit it to be folded and/or steamed or otherwise collapsed to increase the bag's flexibility, while still maintaining its integrity during subsequent processing steps including exposure to the pressurized propellant.

The insertable bag and the insertion method have several additional disadvantages. Not only is the assembly process relatively slow, cumbersome and expensive due to the special steps required to prepare the bag for insertion through the valve opening but they may also produce non-uniform surfaces and cracks, especially around the bag opening, resulting in poor sealing characteristics at the valve opening/bag interface which permit propellant and/or product leakage or permeation out of the container. This increases with the age of the unfilled bag. Attempts to utilize a gasket or adhesive to seal the interface have not been entirely successful and also increases manufacturing costs and crimp leakage problems. Furthermore, since the bag is typically made of a relatively thin plastic to enhance its flexibility, the propellant pressure tends to collapse the middle of the bag and trap product at the bottom of the bag.

In one type of filling operation, the insertable bag may be filled atmospherically through a bag opening prior to a valve cup being attached to seal the valve opening and pressurization of the propellant chamber. Unfortunately, this type of filling operation may result in trapped air in the product chamber. It also requires expensive refrigeration filling for post-foaming products that expand or foam at normal room temperatures. In another type of filling operation, the valve cup is first crimped to the valve opening, the product chamber is evacuated to remove any trapped air, the propellant chamber is pressurized and then the product chamber is filled through a nozzle in the valve cup.

In order to prevent collapse of the middle portion of the insertable bag, another type of container that will be referred to as a "pleated bag container" was developed. The pleated bag container utilizes a non-cylindrical bag having a plurality of pleats or folds disposed along the longitudinal axis of the bag. The pleats collapse in an accordion-like manner along the longitudinal axis in response to the internal propellant pressure while preventing the radial collapse of the middle portion of the bag. The pleated bag, however, can not be inserted into the valve opening and must be inserted into the container before the top closure is attached to the can body. After the top closure is attached to the container body, the bag is positioned so that a neck portion of the bag rests on the valve opening, the upper portion of the bag is cut forming a vertical flange which is heat formed to the valve opening, and the flange is sealed between the valve cup and the top closure seal. The bag may be filled atmospherically through the bag opening prior to the attachment of the valve cup to the body. Alternatively, the bag may be loaded with product after the bag is evacuated and the propellant chamber pressurized.

Unfortunately, the pleated bag container has several disadvantages. The pleated bag is relatively difficult and expensive to manufacture. The pleated configuration of the bag may also lead to fracture or failure due to the rapid contraction/expansion of the bag as the bag is first evacuated and then forced filled. Further, the pleated configuration has significantly more surface area than the non-pleated bag which requires more plastic and increases permeation of the propellant through the increased surface area. Although the pleats prevent full collapse of the bag, they also decrease the capacity of the bag and prevent full evacuation of product from the bag resulting in greater product loss.

SUMMARY AND OBJECTS OF THE INVENTION

Accordingly, it is an object of the present invention to provide an aerosol dispensing container having a cylindrical bag which is easy and inexpensive to manufacture and which does not require expensive steaming or folding steps for assembly into the container.

It is another object of the invention to provide an aerosol dispensing container containing a cylindrical bag which has improved sealing characteristics. A related object of the invention is to provide an aerosol dispensing container wherein the thickness of the bag may be more easily controlled.

A more specific object of the invention is to provide an aerosol dispensing container containing a cylindrical bag which may be pre-evacuated, filled, and dispensed without failure. A related object is to provide a container having a cylindrical bag which maximizes the product volume while minimizing bag surface area and permeation of the propellant.

Yet another object of the invention is to provide an easier and less expensive method for assembling an aerosol dispensing container.

These and other features and advantages of the invention will be more readily apparent upon reading the following description of a preferred exemplified embodiment of the invention and upon reference to the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
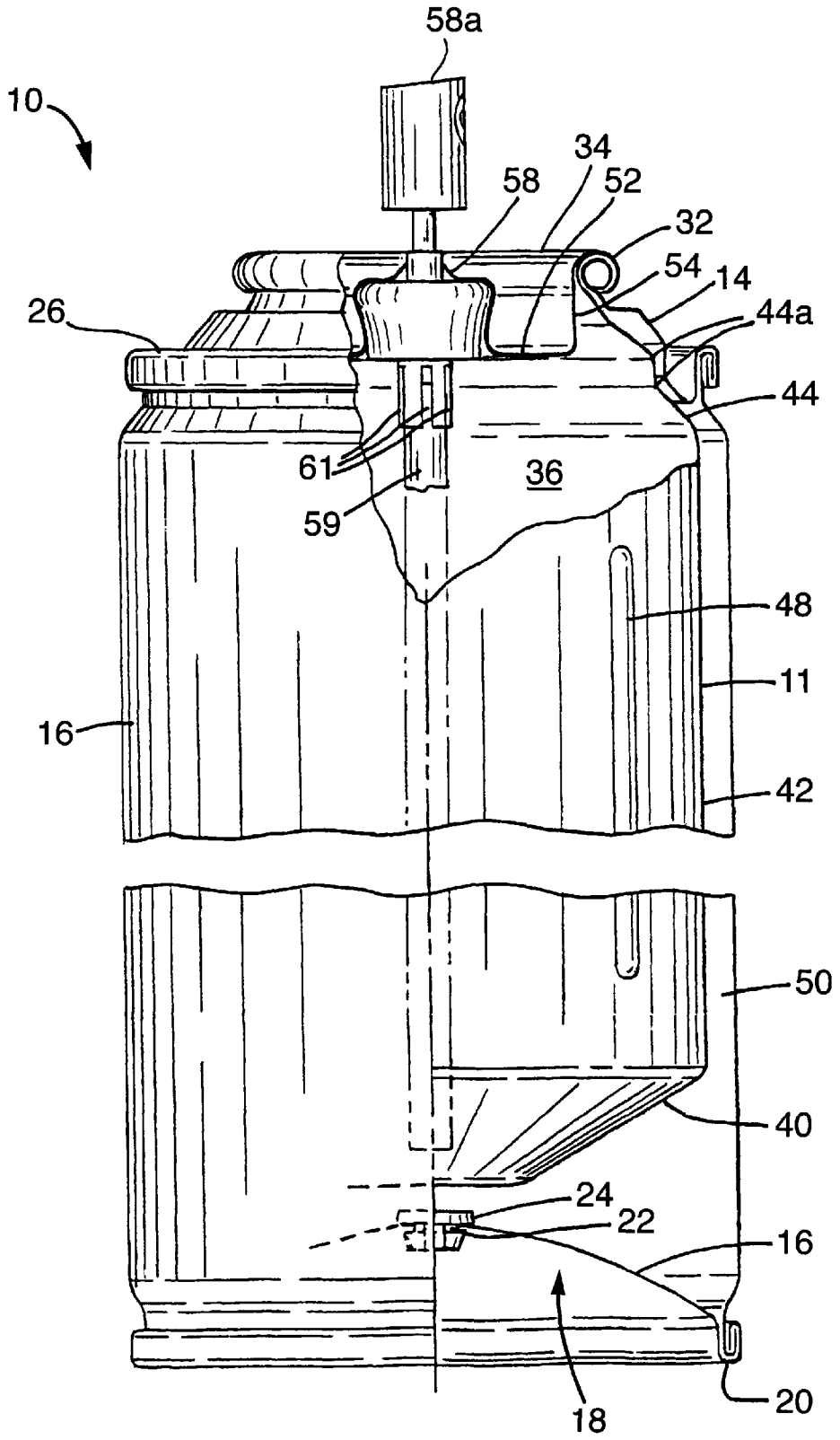
FIG. 1 is an elevational view of an aerosol dispensing container in accordance with the present invention, a portion of the container and bag being broken away and shown in section.

Referring to the figures, and particularly Fig. 1, there is shown an assembled dispensing container 10 having a collapsible bag 11 in accordance with the present invention. The dispensing container 10 includes a preferably cylindrical and metallic tubular body 12. The body 12 has opposing top and bottom openings which are sealed by respective upper and lower closures 14, 16. The closures 14, 16 are secured to the body 12 by a conventional double seam.

The lower closure 16 is preferably constructed from a metallic material and includes a generally upwardly dome-shaped or arcuate-shaped lower end panel 18. The end panel 18 has a peripheral edge portion 20 and an aperture 22. A conventional grommet 24 or plug is disposed in the aperture 22 for selectively sealing the aperture 22.

Figure 5:
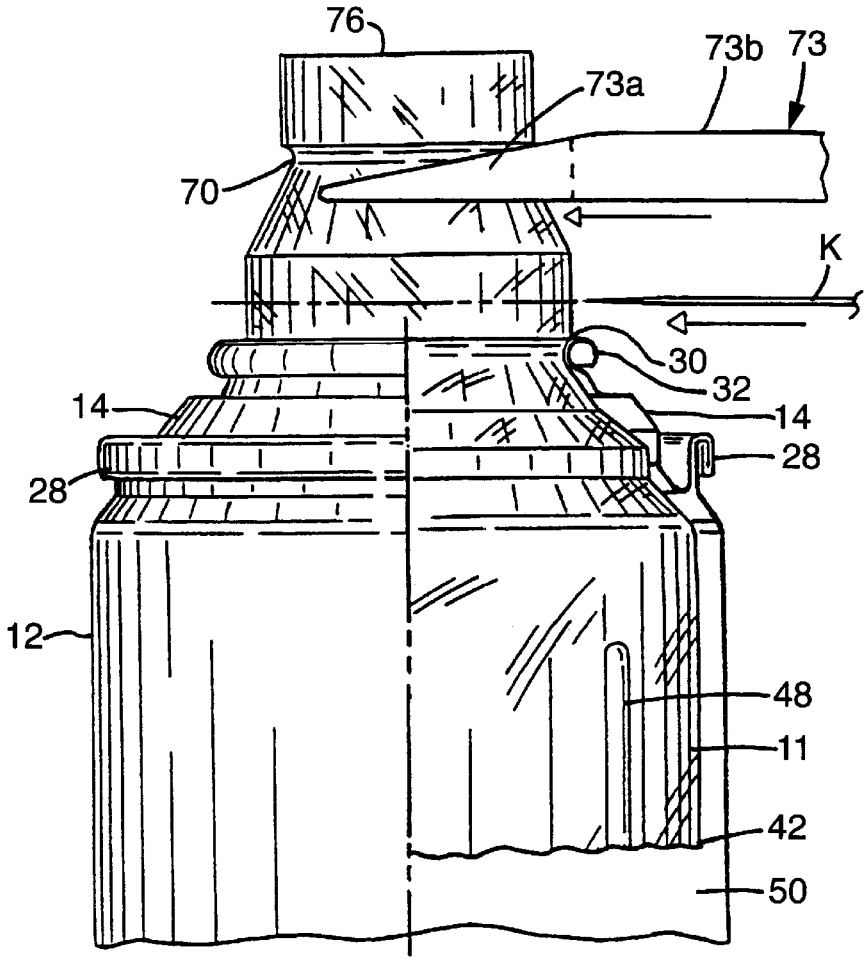
Figure 8:
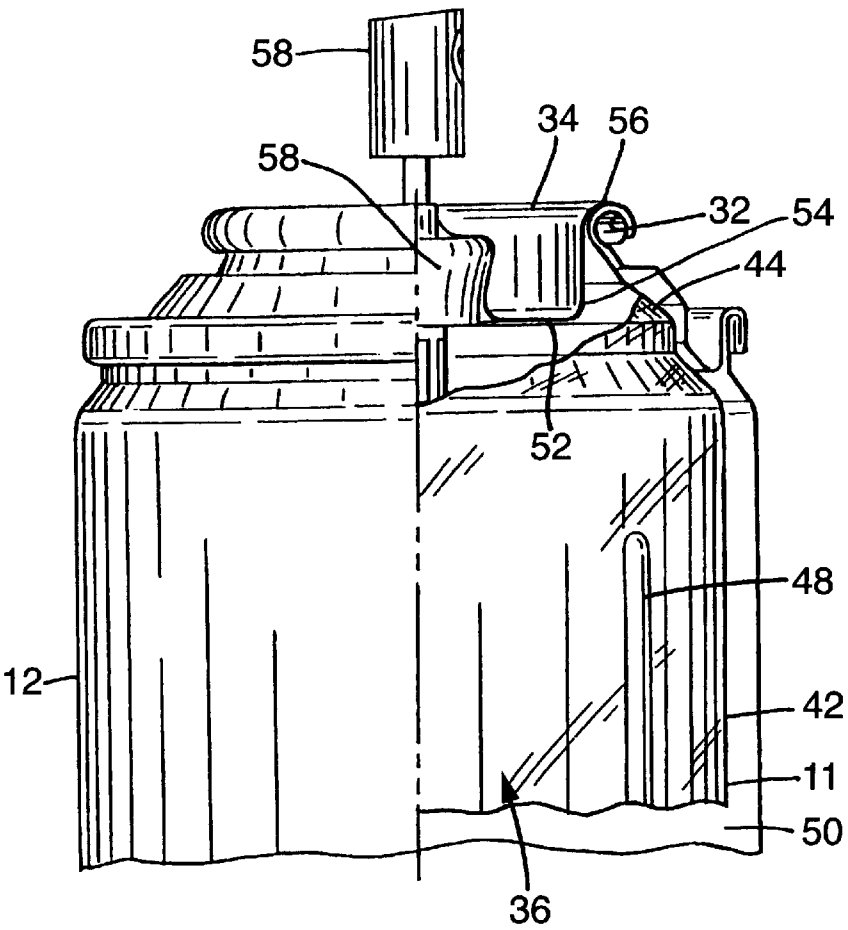
FIG. 8 is an elevational view showing the container during the assembly operation wherein the valve cup is attached to the container body.
Figure 7:
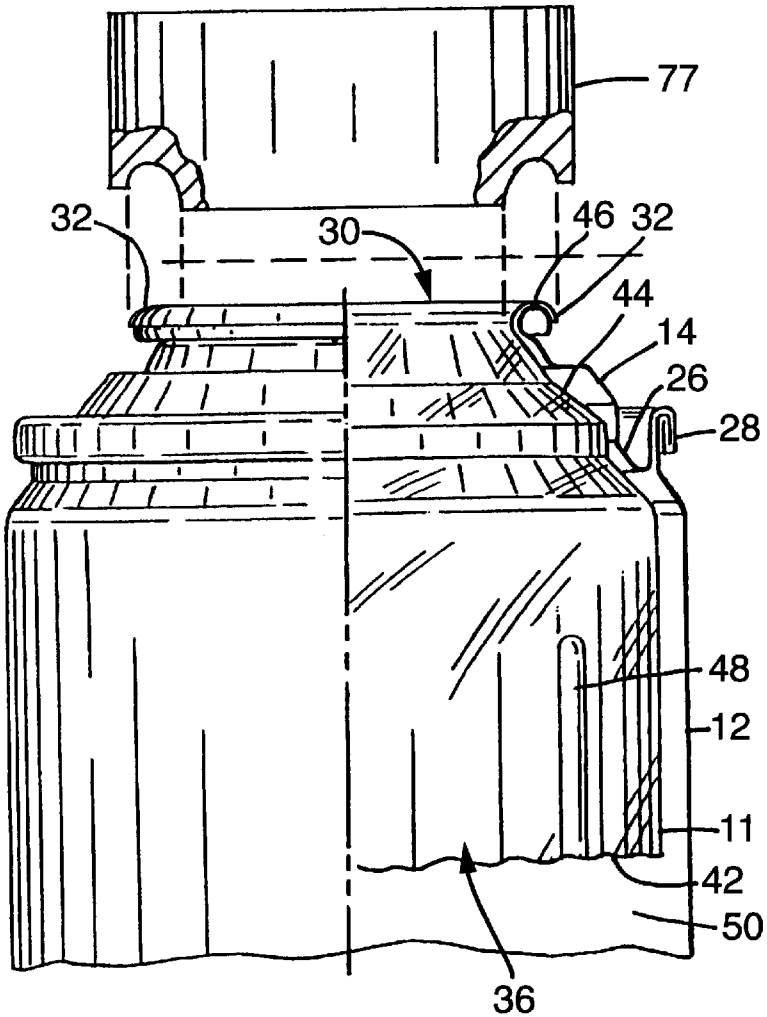
FIG. 7 is an elevational view showing the container during the assembly operation wherein the flange is conformed to the Curl.

The upper closure 14 has a generally dome-like or conical configuration defining a base 26 which is secured to the body 12, preferably by a conventional double seam 28. The upper closure 14 also defines a valve opening 30 (best shown in FIG. 2). The peripheral edge of the valve opening 30 forms a smooth-surfaced, arcuate-shaped curl 32 which extends upwardly and outwardly from the center of the opening 30. The curl 32 interacts with a bag 11 and a valve cup 34 to form an air-tight seal at the valve opening 30. As best shown in FIG. 5, the valve opening 30 communicates with a bag opening and the interior of a collapsible product chamber (generally referenced as 36) which is defined by the interior of the bag 11.

FIGS. 1 and 8–10 illustrate the bag 11 disposed inside the container 10 after the container 10 has been fully assembled whereas FIGS. 2–7 illustrate the bag 11 during various assembly stages. Referring to the final assembled bag 11 shown in FIGS. 1 and 8–10, the bag 11 has a base portion 40, a body portion 42 and a top or neck portion 44. The body portion 42 has a generally cylindrical shape which is dimensioned to slidably insert into the container body 12 through the top body opening prior to attachment of the top closure 14. The base portion 40 has a generally domed or conical shape for resisting the internal pressure of the container. The neck portion 44 has a generally upwardly tapering shape which prevents withdrawal of the bag 11 through the valve opening 30. In the preferred embodiment shown in the figures, the neck portion 44 has generally tapering conical section forming a plurality of shoulders 44*a* which reinforce the neck portion 44 of the bag 11. In the assembled stage, the neck portion 44 also defines a top flange 46 (best shown in FIG. 7) which conforms to the shape of the curl 32. The bag 11 may be made from any suitable material such as plastic or relatively ductile metallic materials, or a lamination of a plastic film material. It has been found that nylon, polyethylene or mixtures thereof are particularly suitable materials for the bag.

The interior of the bag 11 defines a product chamber 36 which is adapted to receive and selectively dispense products such as shaving gels, creams, corrosive cleaners and the like. The walls of the product chamber 36 preferably has a relatively uniform and smooth cross-sectional thickness and may have longitudinally-extending ribs 48 for enhancing the structural integrity of the bag 11.

As shown in FIG. 1, propellant chamber 50, defined by the interior of the can 10 and the exterior of the product chamber 46, is adapted to receive conventional pressurized propellant including, but not limited to hydrocarbons, compressed gases and the like. As is conventional, propellant may be introduced into the propellant chamber 50 by accurately seating the lower closure 18 upon a filling head (not shown) which includes a sealing gasket (not shown) and a conduit (not shown) in fluid communication with a propellant source (not shown). The propellant is introduced into the chamber 50 through the aperture 22 and a gap formed upon the upward flexing of the illustrated umbrella-type grommet 24. The gap is formed in response to the inward/upward pressure exerted on the interior portion of grommet 24 by the incoming propellant. After a predetermined quantity of propellant is introduced into the propellant chamber 50, the propellant source is terminated and the pressure of the propellant inside the container 10 exerts a downward force on the grommet 24 sealing the aperture 22.

The valve cup 34 has a base 52, a cylindrical wall 54, and an arcuate-shaped curl or flange 56. The body wall 54 is dimensioned for slidable insertion into the bag opening and the valve opening 30. In accordance with certain objects of the invention, the internal surface of the flange 56 is adapted to receive the curl 32 of the valve opening 30 and cooperatively capture a portion of the plastic bag 11 therebetween to form an air-tight seal at the interface of the valve flange 56, closure curl 32, and bag 11 when the valve is crimped in place. The air-tight seal prevents the escape of product or propellant contained in the container 10. The base 52 of the valve cup 14 is also adapted to receive a conventional dispensing member 58 for selectively dispensing the product.

A dispensable product may be atmospherically introduced into the product chamber 36 through the bag opening or through a dispensing member 58 after the valve cup 14 is attached to the container body 12. The dispensing member 58 is preferably valve actuated and, upon depressing a plunger 58*a*, the product within the chamber 36 is dispensed in a conventional manner under the influence of a propellant. In order to prevent product from being trapped in a collapsed bag 11, the dispensing member 58 preferably has a stem 59 adapted to receive product at the bottom of the bag 11 and a plurality of slots 61 adapted to feed product from the top of the bag 11.

Figure 2:
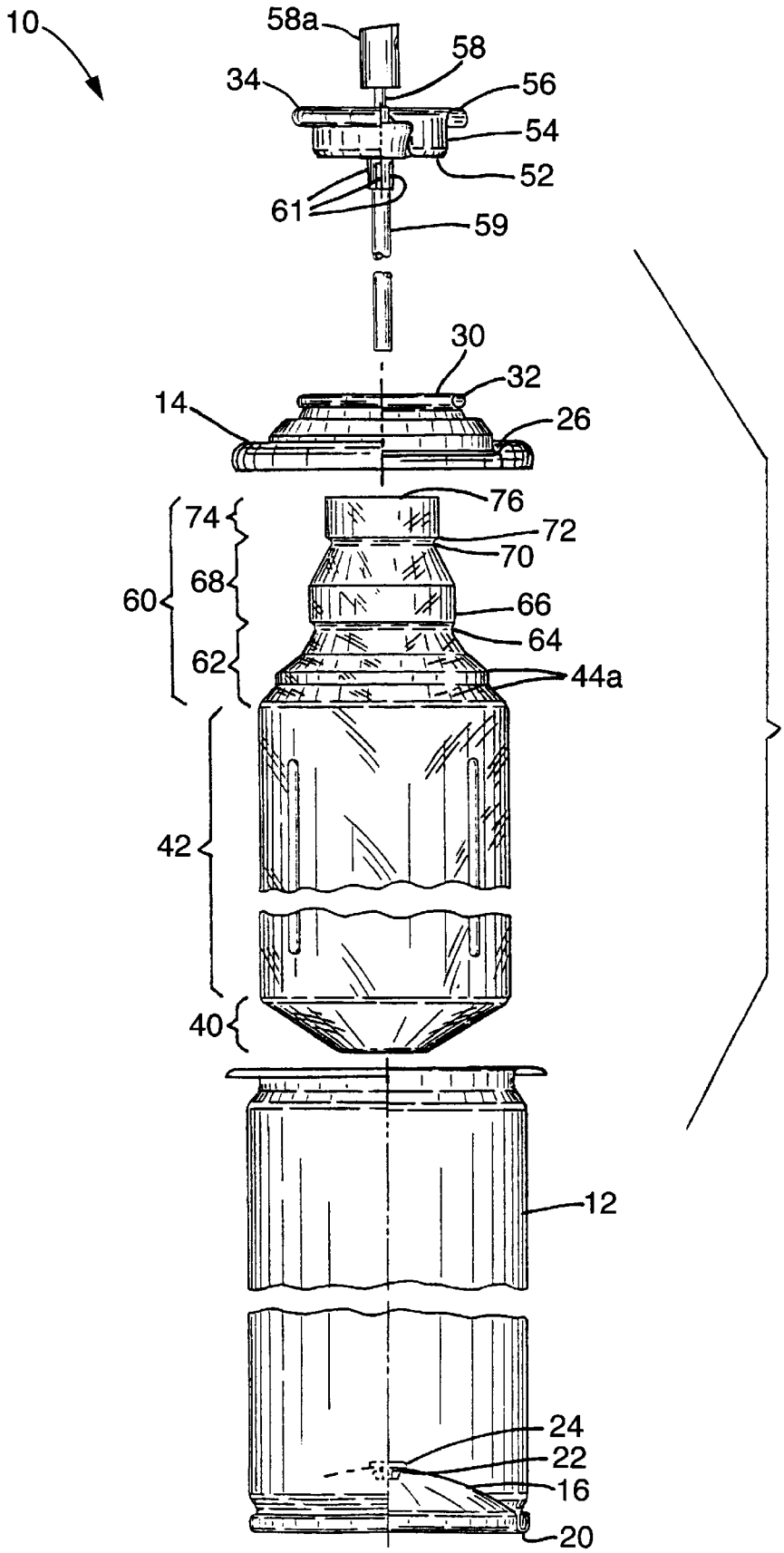
FIG. 2 is an exploded view of the dispensing container.
Figure 9:
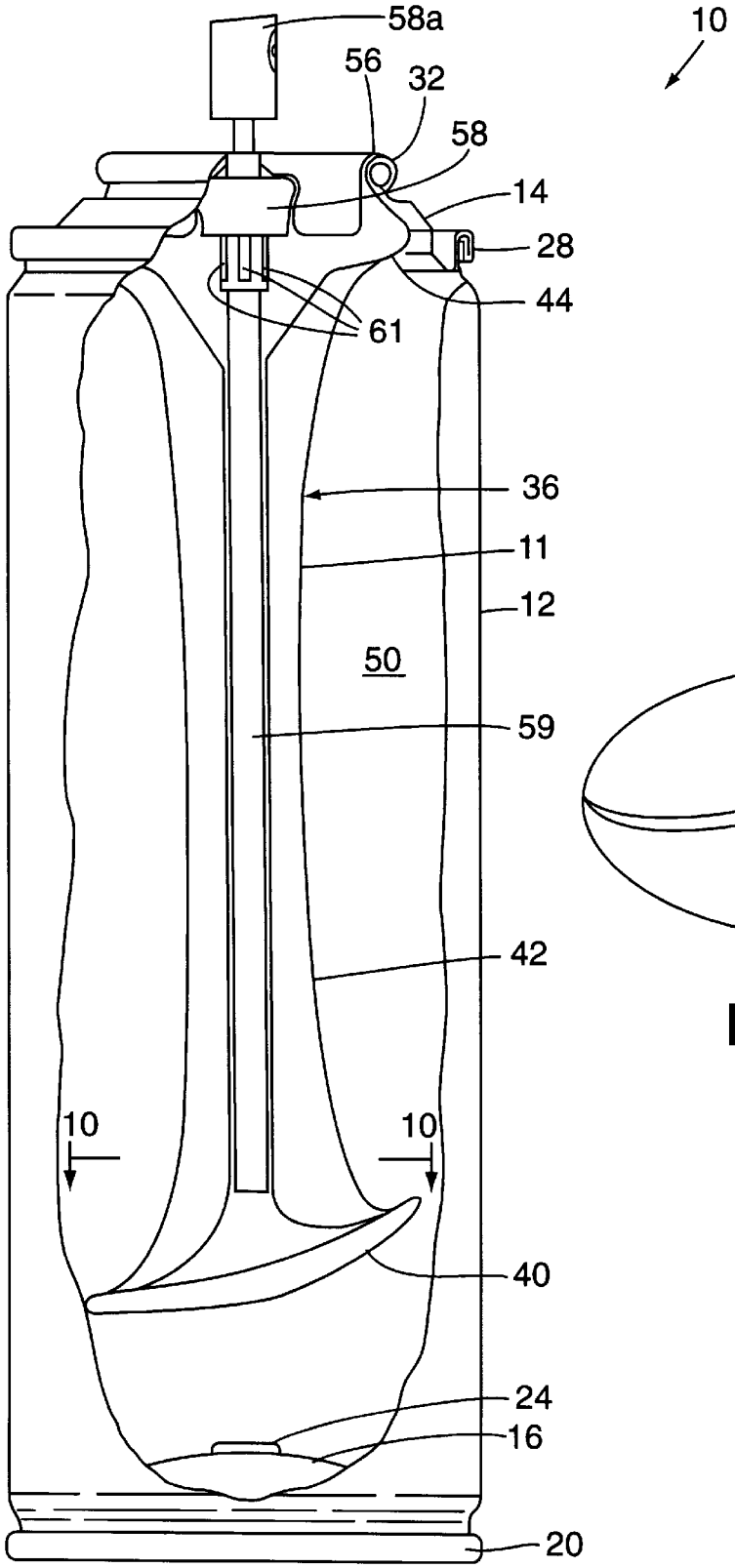
FIG. 9 is an elevational view of the container, a portion of the container being broken away to show the contraction of the empty bag in response to the pressurized propellant.

In order to assemble the container 10, the container body 12 is attached to the bottom end closure 16 by conventional seaming methods as shown in FIGS. 1–2 and 9. The grommet 24 is preferably attached to the aperture 22 before the closure 16 and the container body 12 are attached, but may also be attached after such attachment.

The plastic bag 11 may be manufactured using conventional extrusion, molding or other techniques. The bag 11 should be dimensioned and configured to slidably engage the interior dimensions of the container body 12. In the preferred embodiment in FIG. 2, it will be seen that the outer diameter of the bag body 42 must be dimensioned to fit within the inner diameter of the top opening of the container 12 which is smaller than the inner diameter of the container body 12. In accordance with certain objects of the invention, the bag 11 may be configured to maximize the volume of the product chamber 36 while controlling the size of the product chamber 50. In a preferred embodiment, the bag 11 has a generally cylindrical shape to maximize the amount of product that fits in the product chamber 36, while minimizing surface area and permeation losses of the propellant.

In accordance with certain objects of the invention and in contrast to the prior art "insertable" type bag, the initial configuration of the bag 11 (shown in FIGS. 2–6) has a generally tapered top portion, generally referenced as 60 in FIG. 2, which is specially designed for insuring that a effective seal is provided at the bag/valve cup interface. The top portion 60 has a first conical or tapered section 62 for reinforcing the upper portion of the bag body 42 and resisting collapse. The first conical section 62 tapers inwardly to a first groove 64 which defines a first shoulder 66. The outer diameter of the first shoulder 66 is slightly larger than the inner diameter of the valve opening 30. A second generally conical or tapered section 68 tapers inwardly to a second groove 70 defining a second shoulder 72. The second shoulder 72 is adapted for vertically positioning the bag during the assembly process as discussed below. A third section 74 projects outwardly from the second shoulder 72 and defines an opening 76.

Figure 10:
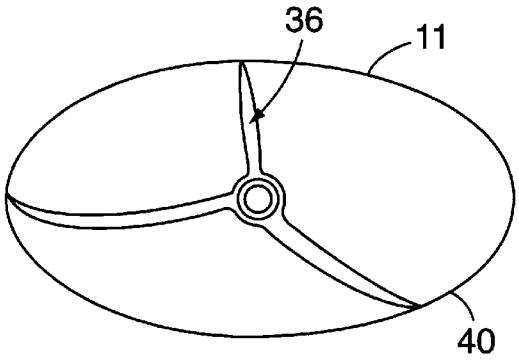
FIG. 10 is a cross-sectional view of the bag taken along line 10—10 in FIG. 9.

FIGS. 9–10 illustrate the container 10 after the bag 11 has been fully collapsed by the propellant. It should now be appreciated that loss of product due to the bag design has been minimized or even eliminated. Even though the entire middle portion of the bag 11 has collapsed about the stem 59, the stem 59 and the slots 61 have cooperated to dispense any product from the bottom and top of the bag 11, respectively. The shoulders 44*a* and the base portion 40 minimize and prevent collapse of the ends of the bag 11.

In the assembly operation, the assembled container body 12 and bottom closure 16 are positioned under the bag 11 so the bag 11 may be inserted into the container body 12 either by gravity feed or by positive insertion. The top closure 14 is mounted into initial contact with the container body 12 by slidably inserting the opening 30 of the top closure 14 over the top portion 60 of the bag 11 as generally shown in FIG. 2. It will be appreciated that the dimensions of the third and second sections 74, 68 generally taper outwardly for guiding and insuring properly orientation and engagement between the peripheral edges 26 of the top closure 14 and the container body 12. The peripheral edges 26 of the top closure 14 and the container body 12 are seamed together in a conventional manner.

Figure 4:
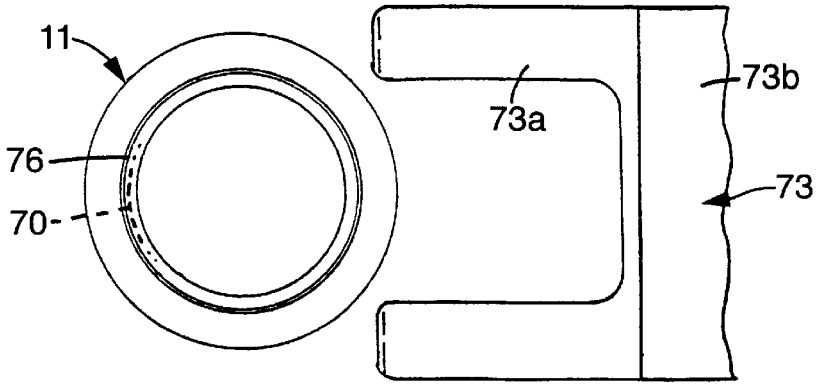
FIGS. 3–4 are elevational and top views, respectively, showing the container during the assembly operation wherein the bag has been inserted into the container.
Figure 3:
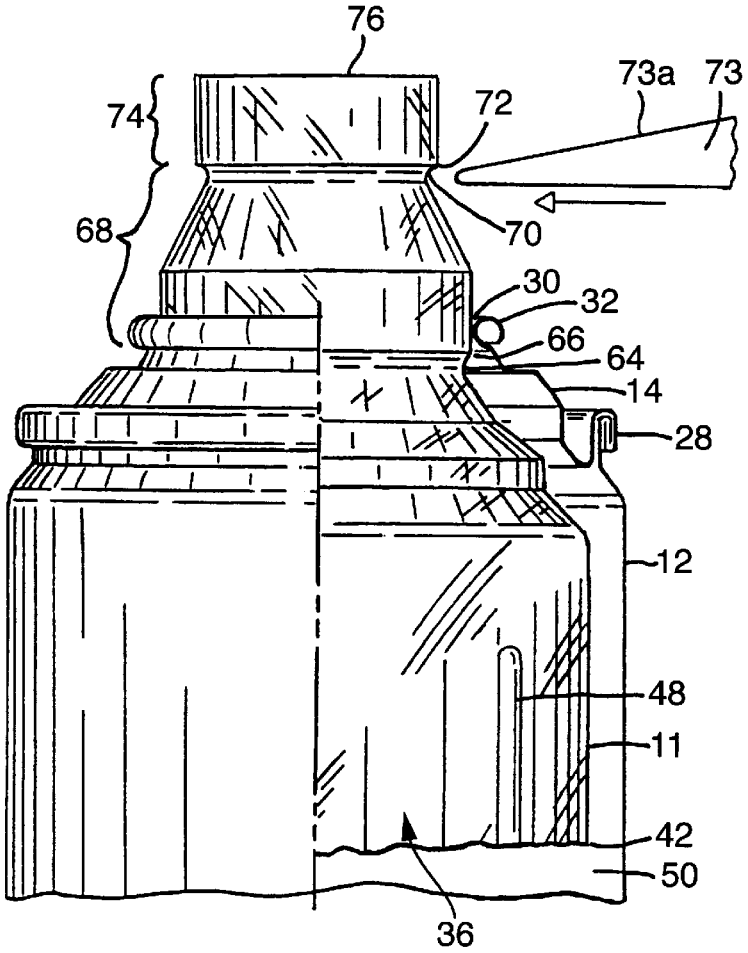
Figure 6:
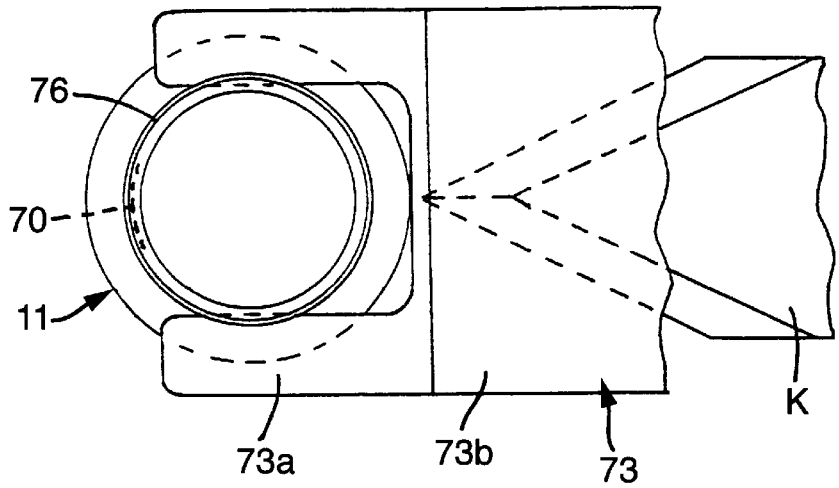
FIGS. 5–6 are elevational and top views, respectively, showing the container during the assembly operation wherein the bag is initially cut to form a flange.

After the top closure 14 and the container body 12 are attached together as shown in FIG. 3, the container 10 and the bag 11 are positioned so that the second shoulder 70 engages a gripper member which is schematically shown in FIGS. 3–6. As the bag 11 moves to the right in FIGS. 3–6, the second groove 70 slidably engages an inclined section 73*a* of the gripper 73 which acts to pull the second shoulder 70 and the bag 11 upwardly relative to the container 10 so that the curl 32 slidably engages the first groove 64 as shown in FIG. 4. The tapered configuration of the first conical section 62 limits upward movement of the bag 11. The resilient nature of the plastic bag 11 permits the first shoulder 70 to deform and slide past the curl 32. As shown in FIG. 4, the first shoulder rests on the curl 32 preventing downward movement of the bag 11.

During a subsequent cutting operation the knife K (schematically shown in FIGS. 5–6) cuts through the second section 68 leaving an upwardly projecting flange 46. The remaining portion of the second section 68 and the third section 74 are subsequently discarded by the horizontal section 73*b* of the gripper 73. A heated sealing member 77, schematically shown in FIG. 7, deforms and stamps the flange 46 outwardly, forming an arcuate-shape which conforms to the dimensions and configuration of the curl 32. The shoulder-like flange 46 prevents the bag 11 from downward movement into the container 12.

In accordance with certain objects of the invention, it should now be appreciated that present technique permits the controlled assembly of the bag 11 into the container 10 in contrast with conventional techniques which require steaming or folding in order to insert the bag through the valve opening 30. Furthermore, the thickness and physical configuration of the neck portion and the flange 46 may be controlled to provide a uniform flange thickness to achieve proper sealing characteristics and to eliminate any folds, cracks or other surface irregularities which may otherwise interfere with an air-tight seal. The pre-cut thickness of the flange 46 and the second section 68 should permit the flange 46 to be heated and deformed to conform to the surface of the curl 32 and eliminate any gaps therebetween which may create insufficient seals. In a preferred embodiment, the pre-cut flange thickness may be about 15 to 35 inches and the post-heated flange thickness may be about 14 to 24 inches.

In order to assemble the valve cup 34, the base 52, and walls 54 are slidably inserted into the opening of the bag 11. It will be appreciated that the bag flange 46 is disposed between the flange 56 of the valve cup 34 and the curl 32. In order to create an air tight seal at the interface of the flange 46 and the curl 32, the walls 54 are crimped outwardly and under the curl 32, tapping the bag flange 46 between the walls 54 and the curl 32.

As previously discussed, the bag may be evacuated through the dispensing means 56 and the propellant may be introduced into the propellant chamber 50 by accurately seating the lower closure 16 upon a filling head which includes a sealing gasket and a conduit in fluid communication with a propellant source. The propellant is introduced into the chamber 50 through the aperture 22 and a gap formed upon the upward movement of the grommet 24. The product is then introduced into the product chamber 36 through the dispensing means 56.

Thus, it will be seen that a novel and improved aerosol dispensing container and method of assembly has been provided which attains the aforementioned objects. Various additional modifications of the embodiments specifically illustrated and described herein will be apparent to those skilled in the art, particularly in light of the teachings of this invention. The invention should not be construed as limited to the specific form shown and described, but instead is set forth in the following claims.

What is claimed is:

1. An aerosol dispensing container comprising:

a container body having bottom and top ends.

a bottom closure sealably attached to the bottom end of the container body, a generally cylindrical flexible product bag sized to be received within the container body after the bottom closure is attached to the container body, wherein the bag has a neck projecting above the top end of the container body and the neck has a shoulder, a top closure having a curl defining a valve opening sealably attached to the top end of the container body after the bag is inserted therein, wherein the valve opening is sized to receive the neck portion after the top closure is sealably attached to the top end of the container body, and the valve opening is slightly smaller than the shoulder so the flexible shoulder retain its shape after it passes through the valve opening, and the neck has a flange defining a bag opening wherein the flange is heat formed to conform to the surface configuration of the curl after the bag is pulled upwardly so the shoulder rests on the curl and a top portion of the neck is separated from the neck.

2. The container as set forth in claim 1 comprising:

a valve cup sized to sealably engage the bag opening wherein the valve cup has a body wall for engaging the bag opening and forming an air tight seal at an interface between the wall and the bag flange, and a product dispenser including a stem for receiving product from the bottom of the bag.

3. The container as set forth in claim 2 wherein the body wall of the valve cup defines a flange for receiving the bag flange and curl.

4. The container as set forth in claim 2 wherein the product dispenser comprises at least one slot disposed in proximity to the body wall for receiving product from the top of the bag.

* * * * *

UNITED STATES PATENT AND TRADEMARK OFFICE

CERTIFICATE OF CORRECTION

PATENT NO. : 5,915,595
DATED : June 29, 1999
INVENTOR(S) : Dow et al.

It is certified that error appears in the above-identified patent and that said Letters Patent is hereby corrected as shown below:

Column 1,
Line 3, replace “ends.” with -- ends; --
Line 5, replace “body,” with -- body; --
Line 10, replace “shoulder,” with -- shoulder; --
Line 18, replace “opening,” with -- opening; --

Signed and Sealed this

Eleventh Day of February, 2003

JAMES E. ROGAN
*Director of the United States Patent and Trademark Office*